United States Patent [19]

Nasu

[11] Patent Number: 5,040,442

[45] Date of Patent: Aug. 20, 1991

[54] LAMINATE CUTTING APPARATUS

[75] Inventor: Nobuo Nasu, Fukuyama, Japan

[73] Assignee: Kabushiki Kaisha Kawakami Seisakusho, Hiroshima, Japan

[21] Appl. No.: 573,391

[22] Filed: Aug. 24, 1990

[30] Foreign Application Priority Data

Sep. 20, 1989 [JP] Japan ..... 1-241705

[51] Int. Cl.[5] ..... B26D 9/00; D06H 7/00

[52] U.S. Cl. ..... 83/422; 83/427; 83/428; 83/435; 83/747; 83/751; 83/33; 83/39; 83/939

[58] Field of Search ..... 83/451, 427 X, 428 X, 83/938, 939 X, 940, 33 X, 39 X, 30, 555, 660, 747, 749, 751, 422, 435, 169

[56] References Cited

U.S. PATENT DOCUMENTS 3,587,381 6/1971 Sederberg ..... 83/427 X 4,907,479 3/1990 Nasu ..... 83/427 X

*Primary Examiner*—Frank T. Yost

*Assistant Examiner*—Kenneth E. Peterson

*Attorney, Agent, or Firm*—Ladas & Parry

[57] ABSTRACT

A laminate cutting apparatus includes a cutter head moved horizontally back and forth above a support member which supports a laminate, and a cutting member and piercing blade mounted on the cutter head, with the cutting member comprising a knife-shaped cutting blade or the cutting blade and a cutting blade guide. The upper surface of a cutter rest moved in synchronization with the cutter head and in the same direction is arranged flush with a supporting surface of the support member. There are provided a cutting member receiving body into which receives the cutting member, and a piercing blade receiving body which receives the piercing blade. The cutting member and the piercing blade are adapted so as to turn in the same direction and so as to be raised and lowered independently of each other. Furthermore, the cutting member receiving member is adapted so as to turn in synchronization with the cutting member and in the same direction.

15 Claims, 5 Drawing Sheets

LAMINATE CUTTING APPARATUS

BACKGROUND OF THE INVENTION

This invention relates to a laminate cutting apparatus in which a number of layers of sheet material such as cloth are cut by a knife-shaped cutting blade.

As disclosed in the specification of Japanese Utility Model Publication No. 55-23836, a conventional laminate cutting apparatus includes a cutter head arranged to move in mutually perpendicular X and Y directions above a support member such as a brush table, and a slender, knife-shaped cutting blade, which has a sharp distal end, mounted on the cutter head so as to be capable of being raised and lowered and turned about a vertical axis.

In operation, the cutting blade of the cutting apparatus is lowered and the cutter head is moved horizontally in the X and Y directions usually from the edge of the laminate placed on the support member, thereby transporting the cutting blade. Concurrently, the cutting blade is turned about the vertical axis so as to point the blade edge in the direction of movement. As a result, the laminate is cut into a desired shape over the entirety of its thickness. There are situations in which it is necessary to cut a laminate starting not from the edge thereof but from above by penetrating the laminate on the support surface from its upper side.

With the conventional laminate cutting apparatus of the type described above, the distal end of the cutting blade can experience elastic deformation if the laminate is thick. This can make accurate cutting impossible and there is the danger that the cutting blade will break. Consequently, there is a limitation upon the thickness of the laminate that can be cut at one time. In an attempt to devise an improvement, a cutting apparatus has been developed in which a blade rest that moves beneath the laminate in synchronization with the cutter head mounting the cutting blade is mounted on the laminate support member. However, the cutting blade must be controlled for accurate forward movement with respect to a cutting line while the blade is penetrating the laminate. To this end, it is necessary that the resistance between the laminate and the cutting blade be reduced to make possible the cutting of curves and sharp corners. Ideally, the cutting blade should be made as small as possible in thickness and in terms of width in the direction of travel. However, with a cutting blade of this kind, elastic deformation thereof often makes it impossible for the blade to vertically penetrate the laminate and have its lower end portion received and retained by a blade receiving body of the aforementioned cutter rest. If the laminate is a material such as chemical fiber or PVC leather, the cut made can be fused by the friction between a cutting blade 10 and laminate 48, as shown in FIG. 11, because almost the entire side face of the cutting blade 10 contacts the laminate 48.

As shown in FIG. 12, the friction between the cutting blade 10 and the laminate 48 can be reduced by cutting the laminate 48 using a cutting member 11 comprising the cutting blade 10 and a cutting blade guide 16. However, when the cutting blade guide 16 is provided, there is too much resistance when it is attempted to vertically penetrate the laminate 48 at the start of cutting, thus making such penetration impossible.

SUMMARY OF THE INVENTION

Accordingly, an object of the present invention is to provide a laminate cutting apparatus in which a cutting blade can be held perpendicular at all times when cutting a laminate and the laminate can be cut accurately upon being penetrated by the cutting blade from above rather than from the edge at the start of cutting.

According to the present invention, the foregoing object is attained by providing an apparatus for cutting a laminate, comprising: a support member having a supporting surface for supporting the laminate; a cutter head arranged above the support member for being moved horizontally back and forth; a cutter rest moved in synchronization with the cutter head and in the same direction, the cutter rest having an upper surface disposed flush with the support surface of the support member; a cutting member mounted on the cutter head so as to be capable of being raised and lowered and turned about a vertical axis thereof, the cutting member comprising a knife-shaped cutting blade or the knife-shaped cutting blade and a cutting blade guide; a cutting member receiving body mounted on the cutter rest for receiving a lower portion of the cutting member, the cutting member receiving body being turned in synchronization with the cutting blade and in the same direction; a piercing blade mounted on the cutter head so as to be capable of being raised and lowered and turned about a vertical axis thereof, the piercing blade being thicker than the cutting member, having a longitudinal width (i.e., the dimension in the direction of an elongated slit made in the laminate by the piercing blade greater than that of the cutting member and possessing a sharpened lower end; and a piercing blade receiving body provided on the cutter rest for receiving the lower end of the piercing blade.

The cutter head is moved and then stopped so as to situate the piercing blade above a cutting starting position of a laminate placed upon the support member, the piercing blade is turned about its axis in such a manner that the orientation of the piercing blade will coincide with the orientation of the cutting blade at the start of cutting, the piercing blade is lowered to pierce and pass through the laminate, and the lower portion of the piercing blade is made to penetrate the piercing blade receiving body. As a result, a slit is formed through the entirety of the laminate in the thickness direction thereof at the cutting starting point of the laminate, after which the piercing blade is raised and restored to its initial position. Thereafter, the cutter head is transported and stopped at a position where the cutting member opposes the aforementioned slit, and the cutting member, the orientation of which has been made to coincide with that of the piercing blade, is lowered and passed through the slit, with the lower portion of the cutting blade being received in the cutting member receiving body provided on the cutter rest. Under these conditions, the cutting member is moved to begin cutting the laminate. When this done, the lower portion of the cutting member can readily be fitted into the cutting blade receiving body of the cutter rest at lowering of the cutting member, even if the laminate is thick. The cutting member will penetrate the laminate vertically without bending. As a result, the laminate can be cut accurately without any cutting deviation. In addition, the piercing blade is thicker than the cutting member, has a greater width in the longitudinal direction and possesses a sharpened lower end portion. Consequently, the slit formed by the piercing blade is made larger in size than the cutting member, thereby allowing the lower portion of the cutting blade to be reliably received in the slit as well as in the cutting member receiving body of the cutter rest. Since there is no positional deviation of these elements, there is no danger of the cutting blade being broken. In an apparatus proposed by the applicant in Japanese Patent Application No. 1-144227, which was filed on June 2, 1989, a hole is punched in a laminate using a punch, and the cutting member is fitted into the resulting hole. Unlike this proposed apparatus in which scraps are produced by the punching operation, the apparatus of the present invention forms a slit in the laminate by piercing it with a blade, and therefore no scraps are produced. This makes it possible to dispense with a process for removing the scraps formed by punching.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described with reference to the drawings.

Figure 1:
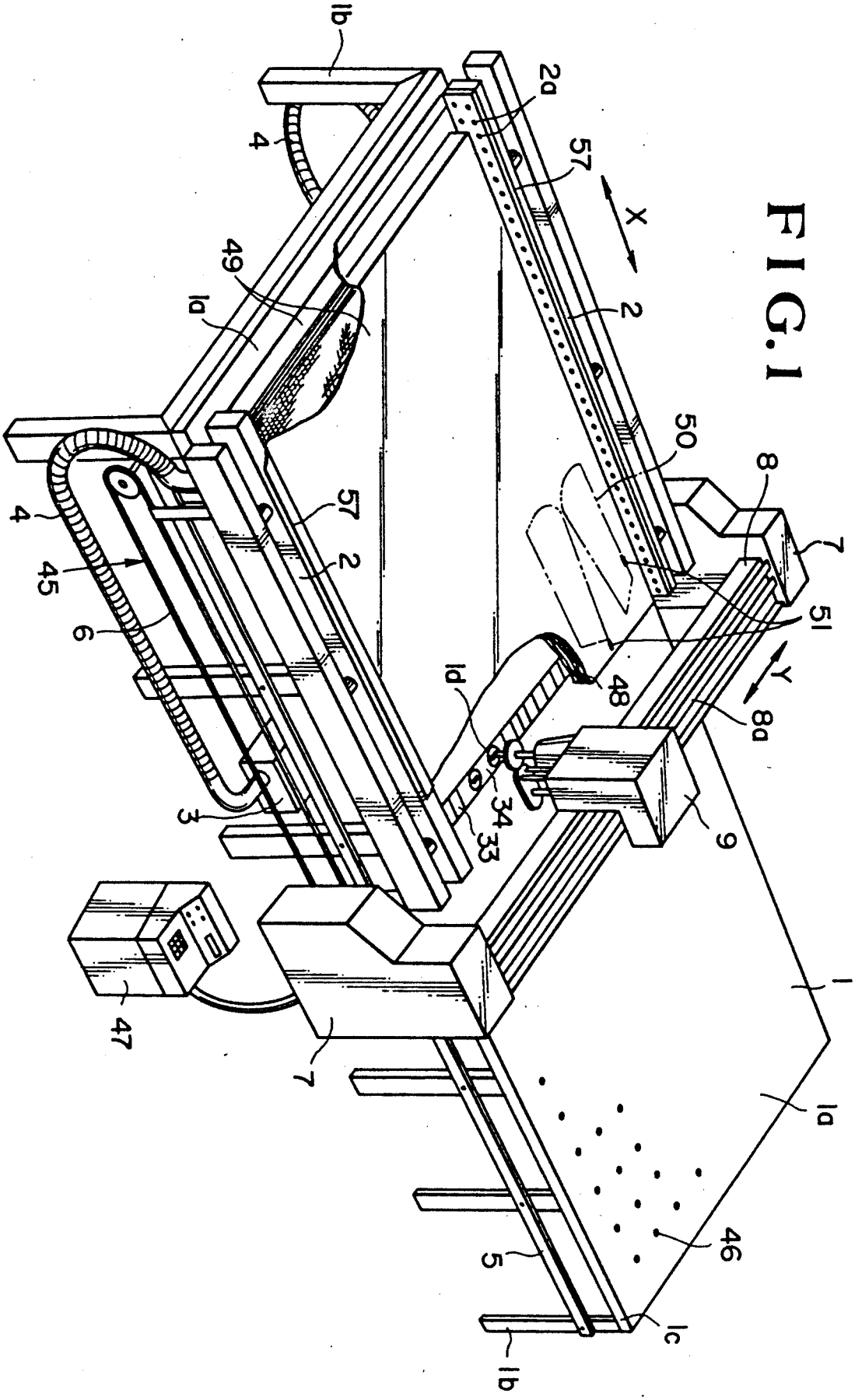
FIG. 1 is a perspective view, a portion of which is cut away, showing an embodiment of a laminate cutting apparatus according to the present invention.
Figure 2:
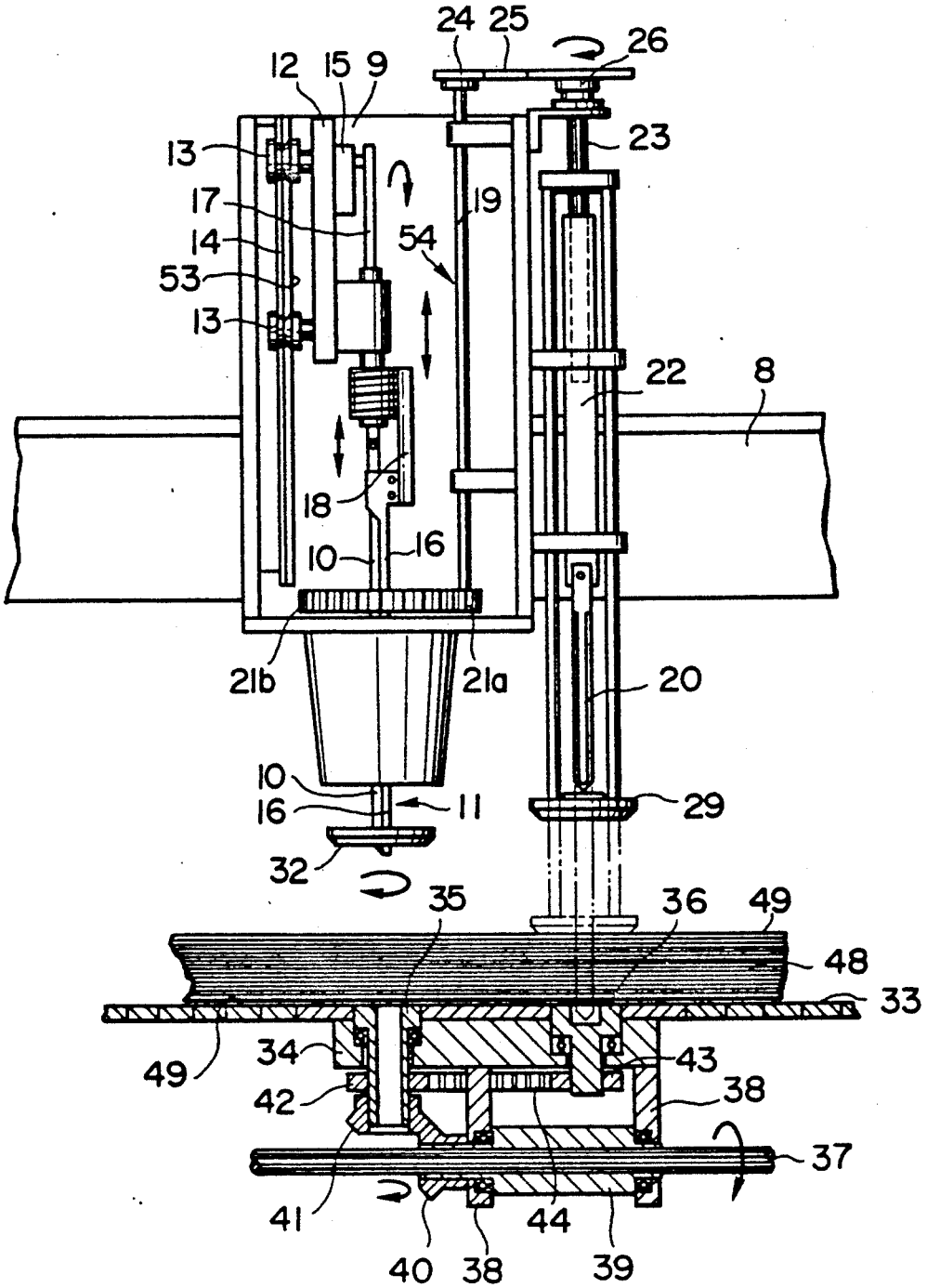
FIG. 2 is a transverse sectional view showing a cutter head of the apparatus.
Figure 3:
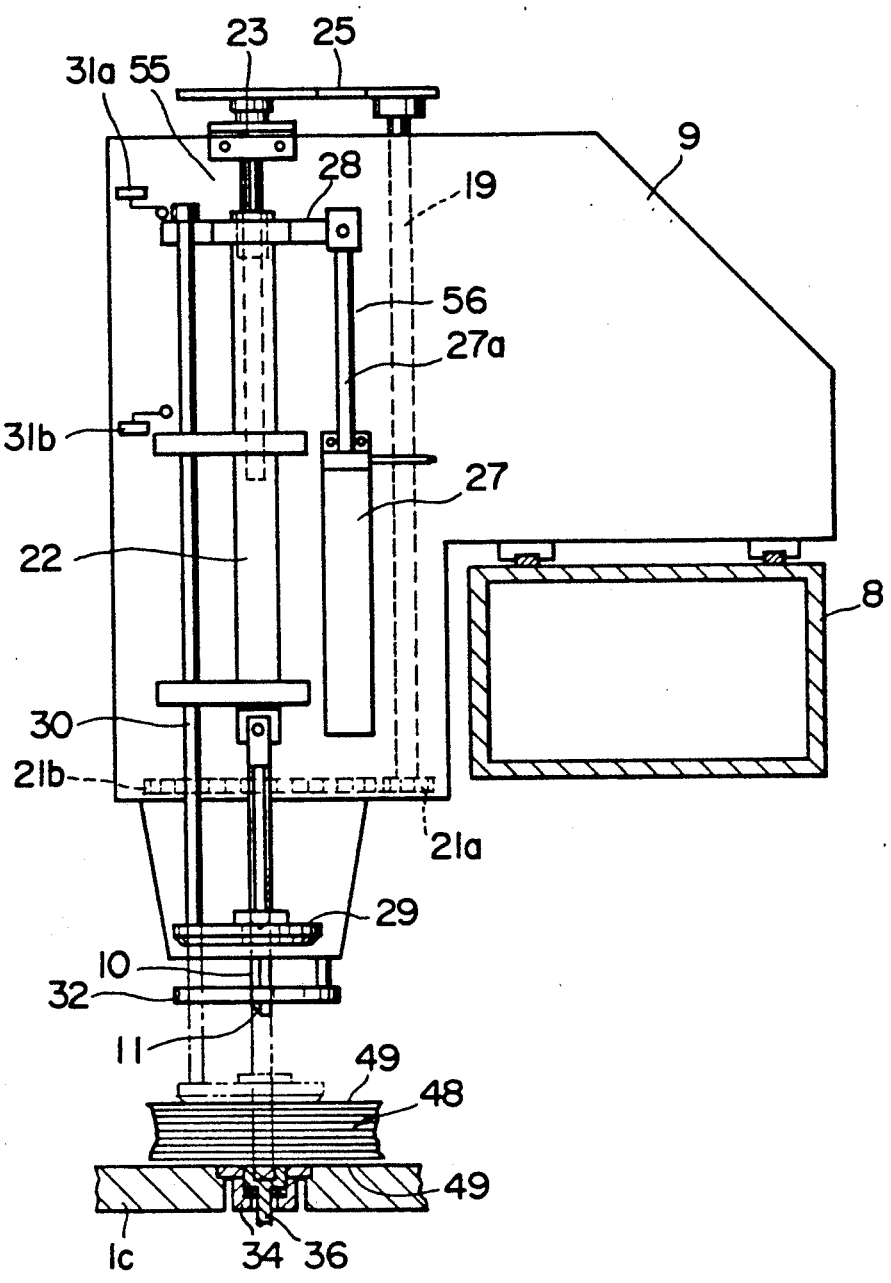
FIG. 3 is a longitudinal sectional view showing the cutter head of the apparatus.

As shown in FIGS. 1 through 3, a laminate cutting apparatus in accordance with the invention includes a pedestal 1 fixed to a floor by legs 1*b* to which a plate 1*c* having a rectangular supporting surface 1*a* is secured. The plate 1*c* thus serves as a support member, left and right suction pipes 2 which move together in the X direction are provided to flank the long sides of the supporting surface 1*a* of pedestal 1. The suction pipes 2 are provided with a number of suction ports 2*a* in their mutually opposing sides and are connected via a flexible hose 4 with a suction source 3, such as a vacuum pump, installed on the floor. Guide rails 5 are provided on both sides of the pedestal 1 and extend over the entire length thereof in the X direction. The suction pipes 2 are supported on these guide rails 5 so as to be horizontally movable back and forth. Endless belts 6 each comprising a chain or timing belt are provided on the pedestal 1 so as to lie parallel to the rails 5, the suction pipes 2 are connected to respective ones of these endless belts, and a reversible motor (not shown) for driving the endless belts 6 is provided on either of left and right frames 7, described below. These components constitute a suction-pipe drive device 45.

The frames 7 are secured to both sides of the pedestal 1 centrally thereof in the X direction and have upper ends upstanding from the plate 1*c*. A beam 8 spans these upper ends of the frames 7 and extends in the Y direction, which is parallel to the short sides of the pedestal 1. The beam 8 has a rail 8*a* on which a cutter head 9 is supported so as to be horizontally movable back and forth.

Figure 6:
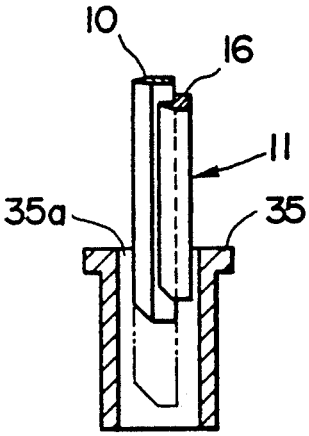
FIGS. 6, 7 and 8 are diagrams illustrating different cutting members and are useful in describing the distal ends of these cutting members.
Figure 9:
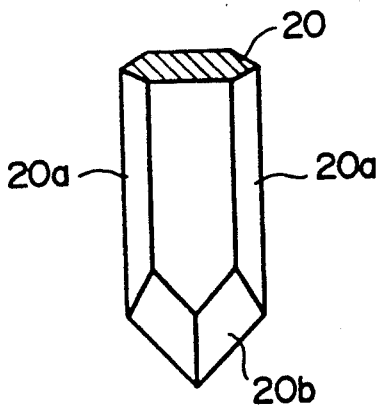
FIG. 9 is a view for describing the distal end of a piercing blade.

As shown also in FIGS. 2 and 3, the cutter head 9 is provided with a cutting member 11 and a piercing blade 20. As illustrated in FIG. 6, the cutting member 11 includes a knife-shaped cutting blade 10 and a cutting blade guide 16, which has a generally U-shaped cross section, fixed to the back of the cutting blade 10. The cutter head 9 is adapted so as to be driven by a cutter-head drive unit, not shown. Provided within the cutter head 9 is an elevating body 12 raised and lowered by an air cylinder mechanism (not shown). Upper and lower rollers 13 axially supported on the elevating body 12 are engaged with a vertical guide rail 14 secured to the cutter head 9. These components construct a cutting member elevating mechanism 53. An elevating shaft 17 is connected to the mechanism 53 via a crank mechanism 15 turned by a driving source (not shown), such as a reversible motor, provided on the elevating body 12. The upper end of the cutting blade 10 is connected to the lower end of the elevating shaft 17 in such a manner that the cutting blade 10 is attachable and detachable and turnable about its axis. The upper end of the cutting blade guide 16 is supported on the lower portion of the elevating shaft 17 via a connecting member 18 in such a manner that guide 16 is capable of turning about its axis and of being raised and lowered. A vertical shaft 19 turned by a driving source outside the cutter head 9 is journalled on the cutter head 9 and has a lower end provided with a gear 21*a* meshing with a gear 21*b*. The cutting blade 10 and cutting blade guide 16 pass through the gear 21*b* and are capable of being raised and lowered. Thus, a cutting member directing mechanism 54 is constructed in such a manner that the cutting member 11, which comprises the cutting blade 10 and cutting blade guide 16, turns about its axis. The piercing blade 20 is arranged parallel to the cutting member 11 in close proximity to it in the Y direction. As shown in FIG. 9, the piercing blade 20 is provided with piercing portions 20*a* on both sides thereof so as to have a hexagonal transverse cross section, and with a sharpened lower end portion 20*b*. The piercing blade 20 has a thickness and a longitudinal width greater than those of the cutting member 11. The upper end of the piercing blade 20 is detachably connected to the lower end of a connecting rod 22, and a spline shaft 23 is engaged with the upper end of the connecting rod 22 so as to be capable of being raised and lowered. A rotating force is transmitted from the upper end of the vertical shaft 19 to the piercing blade 20 via a sprocket 24, timing belt 25, sprocket 26, the spline shaft 23 and connecting rod 22. A piercing blade directing mechanism 55 is thus constructed in such a manner that the piercing blade 20 will turn along with the cutting member 11. As illustrated in FIG. 3, another air cylinder mechanism 27 having a piston rod 27*a* is secured within the cutter head 9. A connecting rod 22 is connected to the piston rod 27*a* via an arm 28. These elements construct a piercing blade elevating mechanism 56. The upper end of a support rod 30 provided on a laminate pressing plate 29 for the piercing blade 20 is engaged with and supported on the arm 28 from its upper side. Upper- and lower-limit switches 31*a*, 31*b* actuated by raising and lowering the arm 28 are secured inside the cutter head 9. A laminate pressing plate 32 for the cutting member 11 also is constructed so as to be actuated by an air cylinder mechanism as well as upper- and lower-limit switches almost in the same manner as the laminate pressing plate 29 for the piercing blade 29. However, the air cylinder mechanism for the laminate pressing plate 32 serves also as the air cylinder for raising and lowering the elevating body 12. The laminate pressing plates 29, 32 are arranged beneath the cutter head 9 and are penetrated by the piercing blade 20 and cutting member 11, respectively.

Figure 4:
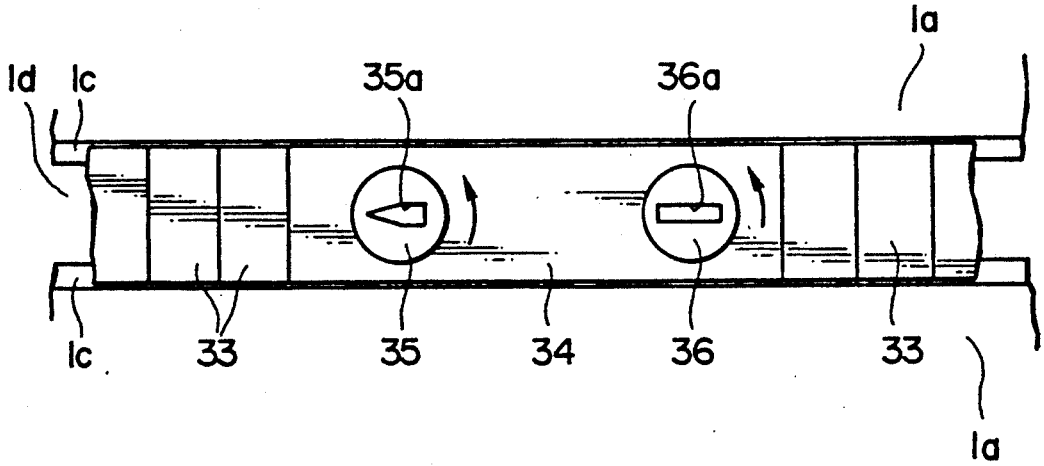
FIG. 4 is a plan view showing a cutter rest.

The supporting surface 1*a* of the pedestal 1 is formed to have a guide groove 1*d* extending in the Y direction. The guide groove 1*d* is disposed directly below the cutter head 9. As shown in FIGS. 2 through 4, a number of closure plates 33 are supported in the guide groove 1*d* so as to be capable of being moved back and forth in the Y direction. A cutter rest 34, described below, is interposed between the closure plates 33. The closure plates 33 and cutter rest 34 are arranged with their upper surfaces flush with the plane of the supporting surface 1*a* and are endlessly connected so as to be capable of flexing. The cutter rest 34 is so arranged as to be driven in synchronization with the cutter head 9 and in the same direction by the same driving source.

As depicted in FIG. 4, a cylindrical cutting member receiving body 35 is held by the cutter rest 34 and is capable of turning about its vertical axis. The cutting member receiving body 35 is disposed directly below the cutting member 11 and is formed to have a directing hole 35*a* in which the cutting member 11 is fitted and supported. As will be described later, the cutting member receiving body 35 is arranged so as to be driven in synchronization with the cutting member 11 and in the same direction. A piercing blade receiving body 36 is provided in the cutter rest 34 opposite the piercing blade 20 and the upper portion thereof is formed to have a directing hole 36*a* in which the piercing blade 20 is received and supported. A lower spline shaft 37 turned in synchronization with the vertical shaft 19 by the same driving source is arranged beneath the cutter rest 34. The lower spline shaft 37 is slidably engaged with a spline nut 39 the axial movement of which is restricted as a result of the nut being provided between a pair of brackets 38 secured to the lower surface of the cutter rest 34. A bevel gear 41, which is fixedly fitted on the cutting member receiving body 35 in coaxial relation therewith, is in mesh with a bevel gear 40 integrally provided on the nut 39. A timing belt 44 is stretched between a timing gear 42 fixedly fitted on the cutting member receiving body 35 in coaxial relation with the bevel gear 41, and a timing gear 43 fixedly fitted on the piercing blade receiving body 36 in coaxial relation therewith.

In FIG. 1, numeral 46 denotes a number of blow holes formed in the plate 1*c* of pedestal 1 and opening in the supporting surface 1*a*. The blow holes 46 are connected to a compressed-air supply source, such as a compressor blower. Numeral 47 designates a control unit arranged at a suitable location external to the pedestal 1, 48 a laminate, 49 an air-impermeable sheet, and 50 a cutting line.

The operation of the cutting apparatus of the embodiment constructed as described above will now be described.

First, as shown in FIG. 1, the laminate 48, which consists of a number of stacked sheets such as cloth, has its upper and lower surfaces covered by the flexible air-impermeable sheet 49 consisting of vinyl chloride or the like. The laminate 48 thus covered by the air-impermeable sheet 49 is placed on the supporting surface 1*a* of the pedestal 1. The cutting member 11 and the laminate pressing plates 29, 32 are raised in order to place the laminate 48 and air-impermeable sheet 49 on the supporting surface 1*a*. The upper and lower surfaces of the laminate 48 and the periphery thereof, with the exception of the side faces opposing the suction pipes 2, are covered by the air-impermeable sheet 49, the outer sides of the upper and lower surfaces of the suction ports 2*a* are covered by the edge portions of the air-impermeable sheet 49, the air-impermeable sheet is affixed to the suction pipes 2 by an air-impermeable tape 57, and the side faces of the laminate 48 are abutted against the suction pipes 2. Under these conditions, the suction source 3 is driven into operation to draw in air from the suction ports 2*a* via the flexible hoses 4, thereby compressing the laminate 48 in the thickness direction thereof and fixedly attracting both side faces of the laminate to the suction ports 2*a*.

Next, the motor of the suction-pipe drive device 45 is driven into operation to move the suction pipes 2 along with the laminate 48 and air-impermeable sheet 49 in the X direction on the supporting surface 1*a* of the pedestal 1. When this is done, the laminate 48 and air-impermeable sheet 49 encounter no projections that would be an obstacle to movement on the supporting surface 1*a*. Owing to air blown on the supporting surface la from the blow holes 76 provided in the plate 1*c* of pedestal 1, the frictional resistance between the supporting surface 1*a* and the air-impermeable sheet 49 on the lower surface of the laminate 48 is reduced. As a result, the laminate 48 and air-impermeable sheet 49 move smoothly and readily on the supporting surface 1*a*.

By driving the motor of the cutter-head drive unit into operation, the cutter 9 is transported in the Y direction, namely longitudinally of the beam 8, along with the cutting member 11 and piercing blade 20 mounted on the cutter head. At the same time, the cutter rest 34 is transported along with the closure plates 33 in the same direction as the cutter head 9 in synchronization with the cutter-head drive unit. Accordingly, the cutting member 11 and piercing blade 20 mounted on the cutter head 9, as well as the cutting member receiving body 35 and piercing receiving body 36 provided on the cutter rest 34, are moved in both the X and Y directions relative to the laminate 48 while the cutting member 11 and blade 20 are maintained in opposition to the respective receiving bodies 35 and 36 at all times.

Figure 10:
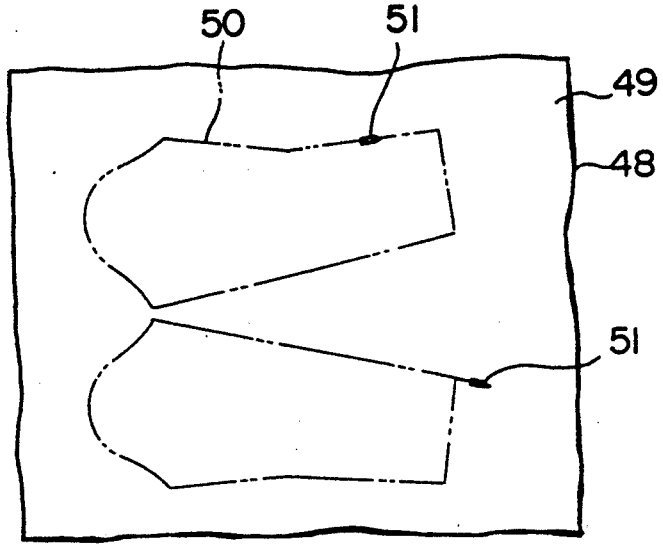
FIG. 10 is a plan view for describing the cutting state of the laminate cutting apparatus shown in FIG. 1.
Figure 11:
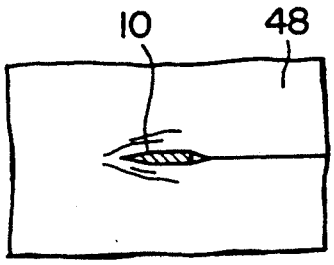
FIGS. 11 and 12 are plan views showing laminates being cut by cutting members according to the prior art.
Figure 12:
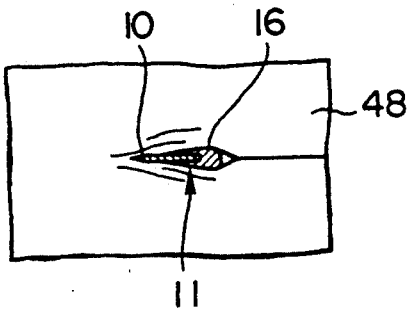

Owing to this movement in the X and Y directions, the piercing blade 20 is brought into position above a cutting starting point on the laminate 48, as shown in FIG. 10, after which movement in the X and Y directions is halted. During this movement or before or after, the vertical shaft 19 provided on the cutter head 9 and the lower spline shaft 37 are driven synchronously by the directing drive mechanisms 54, 55. As a result, the orientations of the cutting member 11 and piercing blade 20 and the orientations of the hole 35*a* in the cutting member receiving body 35 and the hole 36*a* in the piercing blade receiving body 36 are made to coincide with the cutting starting direction. Next, the air cylinder mechanism 27 is actuated to lower the piercing blade 20 and its laminate pressing plate 29 via such elements as the arm 28. When this is done, the laminate 48 and air-impermeable sheet 49 are pressed against the piercing blade receiving body 36 of cutter rest 34 by the laminate pressing plate 29, after which lowering of the piercing blade 20 is continued.

As a result of the foregoing, the laminate 48 and air-impermeable sheet 49 are completely cut through in the thickness direction by the piercing blade 20, whereby a slit 51 is formed at the cutting starting position. In this case, since the piercing blade 20 has a thickness and longitudinal width greater than those of the cutting member 11, and since the lower end portion of the blade 20 is sharpened, the blade 20 does not readily undergo elastic deformation. With the laminate 48 and air-impermeable sheet 49 being pressed against the piercing blade receiving body 36 by the laminate pressing plate 29, the piercing blade 20 is lowered vertically to pierce the laminate 48 and the air-impermeable sheet 49. The fact that the blade 20 does not readily deform makes it possible to form the slit 51 at the correct position even when the laminate 48 is thick.

When the piercing blade 20 fits into the hole **36*a* of the piercing blade receiving body 36 and reaches its lower limit, the lower limit switch 31*b* is actuated by the arm 28 and the air cylinder mechanism 27 is switched over to perform an elevating operation. As a result, the piercing blade 20 is elevated, followed by the laminate pressing plate 29. When these elements return to their elevated states, the upper limit switch 31*a* is actuated by the arm 28, the air cylinder mechanism 27 ceases operating and both the piercing blade 20 and laminate pressing plate 29** are brought to a halt.

Next, the cutter head 9 and cutter rest 34 are moved slightly in the Y direction to situate the cutting member 11 directly above the slit 51 formed by the piercing blade 20, after which the cutter head 9 and cutter rest 34 are stopped. Next, the cutting member 11 and laminate pressing plate 32 are lowered by the air cylinder mechanism that is not shown, as a result of which the portions of the laminate 48 and air-impermeable sheet 49 at the outer periphery of the slit 51 are pressed against the cutter rest 34 by the pressing plate 32. Thereafter, the cutting blade 10 and cutting blade guide 16 of the cutting member 11 continue to be lowered together to pass their lower ends through slit 51 and fit them into the cutting member receiving body 35, whereupon the air cylinder mechanism that is not shown is stopped. The crank mechanism 15 is then actuated by a motor (not shown), thereby repeatedly raising and lowering the cutting blade 10 relative to the cutting blade guide 16 (see FIG. 6). Under these conditions, the laminate 48 and air-impermeable sheet 49 are transported in the X direction along with the suction pipes 2, the cutter head 9 is moved in the Y direction, and cutting member 11 and cutting member receiving body 35 are pointed in the direction of movement of the cutting member 11 by the directing mechanisms 54 and 55, thereby starting the cutting of the laminate 48 and air-impermeable sheet 49. These are cut along the cutting line 50 of the desired shape by the cutting blade 10. Thereafter, the cutting blade 10, cutting blade guide 16 and laminate pressing plate 32 are restored to their elevated attitudes. This operation is then repeated.

If, in this embodiment, slits are formed in a plurality of locations of one laminate by the piercing blade, it is permissible to form all or mutually adjacent ones of the slits in advance, after which cutting by the cutting member may be carried out utilizing these slits.

Figure 7:
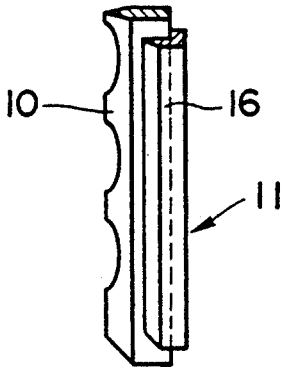
Figure 8:
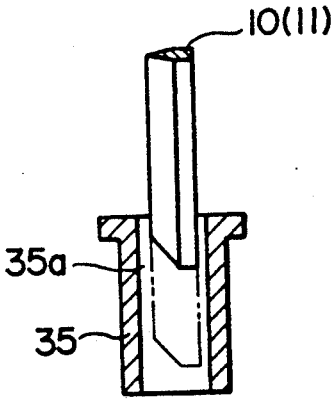

In the present invention, the cutting member 11 can be designed so that the cutting edge of the cutting blade 10 is formed to have serrations continuously along its length, as shown in FIG. 7. Alternatively, the cutting member 11 may comprise solely the cutting blade 10, as shown in FIG. 8.

Further, in the present invention, the timing belts 25, 44 can be replaced by endless chains, by way of example. Thus, the cutter-head drive unit and the directing drive unit are not necessarily limited to those of the above-described embodiment but can be modified in various ways.

Figure 5:
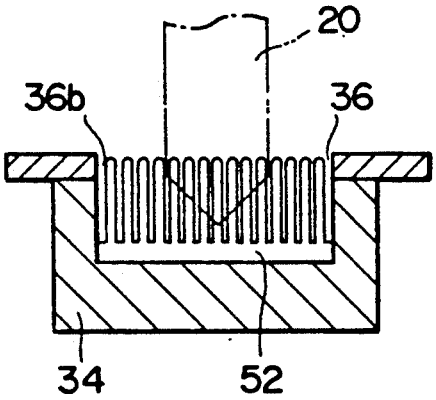
FIG. 5 is a vertical sectional view showing a modification of a piercing blade receiving body.

Furthermore, as shown in FIG. 5, the piercing blade receiving body 36 can be secured to the cutter rest 34 and formed to have a circular hole **36*b* into which the piercing blade 20 is inserted so as to be capable of turning about its axis. Rubber, plastic or a brush-like member 52 can be fitted and retained in a recess of the cutter rest 34 situated below the hole 36*b***.

The present invention can be applied to a laminate cutting apparatus disclosed in Japanese Patent Application No. 63-131389 (filed on May 31, 1988) previously filed by the applicant. Specifically, the present invention can be applied to a laminate cutting apparatus which includes: a frame; a support member comprising a support belt supported on the frame for reciprocating horizontally in a longitudinal direction of the frame and having a support portion for supporting a laminate of sheet material; a number of support plates arranged side by side in the longitudinal direction of the frame and retained thereon so as to be lowerable independently of one another, the support plates supporting a lower surface of the support portion of the support member; suction pipes disposed on opposing side portions of the frame and extending in the longitudinal direction for applying suction to side faces of the laminate supported on the support portion of the support member and having its upper and lower surfaces covered with an air-impermeable sheet; a traveling body supported on the frame for reciprocating in the longitudinal direction; a cutter head supported on an upper portion of the traveling body for reciprocating in a transverse direction; a downwardly extending cutting member mounted on the cutter head for being raised and lowered so as to penetrate the laminate and the air impermeable sheet, the cutting member being turnable about a vertical axis; recess forming rollers arranged in opposed relation below the cutter head of the traveling body and extending in the transverse direction for forming the support portion of the support member into a transversely extending movable recess having an upper surface which is open; a lower receiving member secured to the traveling body and arranged in parallel with the recess forming rollers within the movable recess, the lower receiving member having a groove-shaped cross section; a number of interconnected closure plates accommodated within the receiving member for reciprocating in the transverse direction in synchronization with the cutter head; a cutter rest fitted between closure plates so as to be capable of supporting a lower end of the cutter, the cutter rest being turnable about a vertical axis in synchronization with the cutter; and a cam plate provided on the traveling body for lowering the support plates to a level below the movable recess of the support member; wherein upper surfaces of the laminate support portion of the support member, the lower receiving member, the closure plates and a cutting member receiving body are made substantially flush with the same horizontal plane. In this apparatus, it is possible to adopt an arrangement in which the piercing blade is mounted on the cutter head so as to be capable of being raised, lowered and turned about a vertical axis, the piercing blade is made thicker than the cutting member, wider than the cutting member in the longitudinal direction and has a sharpened lower end, and the cutter rest is provided with a piercing blade receiving body into which the lower portion of the piercing blade is inserted.

Thus, the laminate cutting apparatus of the present invention described above includes a cutter head provided above a support member which supports a laminate, and a cutting member and piercing blade mounted on the cutter head, with the outting member comprising a knife-shaped cutting blade or the cutting blade and a cutting blade guide. The upper surface of a cutter rest moved in synchronization with the cutter head and in the same direction is arranged flush with a supporting surface of the support member. There are provided a cutting member receiving body into which the cutting member is fitted, and a piercing blade receiving body into which the piercing blade is fitted. The cutting member and the piercing blade are adapted so as to turn in the same direction and so as to be raised and lowered independently of each other. Furthermore, the cutting member receiving member is adapted so as to turn in synchronization with the cutting member and in the same direction. As a result, the following advantages are obtained:

In the laminate cutting apparatus of the present invention, the lower portion of the cutting member can readily be fitted into the cutting blade receiving body of the cutter rest at lowering of the cutting member, even if the laminate is thick. The cutting member will penetrate the laminate vertically without bending. As a result, the laminate can be cut accurately without any cutting deviation. In addition, the slit formed by the piercing blade is made larger in size than the cutting member, thereby allowing the lower portion of the cutting blade to be reliably received in the slit as well as in the cutting member receiving body of the cutter rest. Since there is no positional deviation of these elements, there is no danger of the cutting blade being broken. Unlike the aforementioned apparatus proposed by the applicant in Japanese Patent Application No. 1-144227, in which scraps are produced by the punching operation, the apparatus of the present invention forms a slit in the laminate by piercing it with a blade, and therefore no scraps are produced. This makes it possible to dispense with a process for removing the scraps formed by punching.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for cutting a laminate, comprising:
- a support member having a supporting surface for supporting the laminate;
- a cutter head arranged above said support member for movement horizontally back and forth;
- a cutter rest moved in synchronization with said cutter head and in the same direction, said cutter rest having an upper surface disposed flush with the support surface of said support member;
- a cutting member mounted on said cutter head so as to be capable of being raised and lowered and turned about a vertical axis thereof, said cutting member comprising a knife-shaped cutting blade;
- a cutting member receiving body mounted on said cutter rest for receiving a lower portion of said cutting member, said cutting member receiving body being turned in synchronization with said cutting blade and in the same direction;
- a piercing blade mounted on said cutter head so as to be capable of being raised and lowered, independently of said cutting member, and capable of being turned about a vertical axis thereof, said piercing blade being thicker than said cutting member, having a longitudinal width greater than that of said cutting member and possessing a sharpened lower end;
- a piercing blade receiving body provided on said cutter rest for receiving the lower end of said piercing blade; and
- means for moving said piercing blade into and out of the laminate to pierce the laminate and form a slit therein, and for subsequently lowering said cutting member into said slit for cutting the laminate.

2. The apparatus according to claim 1, wherein said support member has laminate moving means for moving the laminate horizontally back and forth in a direction perpendicular to direction of movement of said cutter head.

3. The apparatus according to claim 2, wherein said laminate moving means includes:
- suction pipes arranged on two opposing side edges of said support member for attracting the laminate supported on said support member;
- a source of suction to which said suction pipes are connected; and
- suction-pipe drive means to which said suction pipes are coupled for moving said suction pipes synchronously in the direction perpendicular to the direction of movement of said cutter head.

4. The apparatus according to claim 1, wherein said piercing blade receiving body turns in synchronization with said piercing blade and in the same direction.

5. The apparatus according to claim 1, wherein said cutting member and said piercing blade are provided on said cutter head in side-by-side relation and in close proximity to each other in the direction of movement of the cutter head, and said cutting member receiving body and said piercing blade receiving body are provided on said cutter rest in side-by-side relation and in close proximity to each other in the direction of movement of the cutter head.

6. The apparatus according to claim 1 wherein said means for moving comprises:
- a first mechanism for raising and lowering said cutting member;
- a second mechanism for raising and lowering said piercing blade; and
- means for driving said first and second mechanisms independently of each other.

7. The apparatus according to claim 2, wherein said piercing blade receiving body turns in synchronization with said piercing blade and in the same direction.

8. The apparatus according to claim 3, wherein said piercing blade receiving body turns in synchronization with said piercing blade and in the same direction.

9. The apparatus according to claim 2, wherein said cutting member and said piercing blade are provided on said cutter head in side-by-side relation and in close proximity to each other in the direction of movement of the cutter head, and said cutting member receiving body and said piercing blade receiving body are provided on said cutter rest in side-by-side relation and in close proximity to each other in the direction of movement of the cutter head.

10. The apparatus according to claim 3, wherein said cutting member and said piercing blade are provided on said cutter head in side-by-side relation and in close proximity to each other in the direction of movement of the cutter head, and said cutting member receiving body and said piercing blade receiving body are provided on said cutter rest in side-by-side relation and in close proximity to each other in the direction of movement of the cutter head.

11. The apparatus according to claim 4, wherein said cutting member and said piercing blade are provided on said cutter head in side-by-side relation and in close proximity to each other in the direction of movement of the cutter head, and said cutting member receiving body and said piercing blade receiving body are provided on said cutter rest in side-by-side relation and in close proximity to each other in the direction of movement of the cutter head.

12. The apparatus according to claim 2 wherein said means for moving comprises:

a first mechanism for raising and lowering said cutting member;

a second mechanism for raising and lowering said piercing blade; and means for driving said first and second mechanisms independently of each other.

13. The apparatus according to claim 3 wherein said means for moving comprises:

a first mechanism for raising and lower said cutting member;

a second mechanism for raising and lowering said piercing blade; and means for driving said first and second mechanisms independently of each other.

14. The apparatus according to claim 4 wherein said means for moving comprises:

a first mechanism for raising and lower said cutting member;

a second mechanism for raising and lowering said piercing blade; and means for driving said first and second mechanisms independently of each other.

15. The apparatus according to claim 5 wherein said means for moving comprises:

a first mechanism for raising and lowering said cutting member;

a second mechanism for raising and lowering said piercing blade; and means for driving said first and second mechanisms independently of each other.

* * * * *